United States Patent [19]

Tzu-Chun

[11] Patent Number: 4,607,883

[45] Date of Patent: Aug. 26, 1986

[54] RECLINING MECHANISM FOR EASY CHAIR

[76] Inventor: Huang Y. Tzu-Chun, No. 36, Chien Kuo Rd., Kuei Shan Industrial Park, Tao Yuan, Taiwan

[21] Appl. No.: 768,758

[22] Filed: Aug. 23, 1985

[51] Int. Cl.[4] ..... A47C 1/02

[52] U.S. Cl. ..... 297/317; 297/322; 297/342; 297/320

[58] Field of Search ..... 297/320, 317, 318, 322, 297/342; 248/420

[56] References Cited

U.S. PATENT DOCUMENTS

| | | | |
|---|---|---|---|
| 2,512,353 | 6/1950 | Magaldino et al. | 297/317 |
| 3,947,069 | 3/1976 | Lusch | 297/317 |
| 4,068,888 | 1/1978 | Bottemiller | 297/317 |
| 4,174,088 | 11/1979 | Schaefer et al. | 248/420 |

FOREIGN PATENT DOCUMENTS

| | | | |
|---|---|---|---|
| 2359440 | 6/1974 | Fed. Rep. of Germany | 297/317 |

*Primary Examiner*—Francis K. Zugel

*Attorney, Agent, or Firm*—Burns, Doane, Swecker & Mathis

[57] ABSTRACT

A reclining mechanism for easy chair or swivel chair comprising a guide tube and a jack stay, wherein the guide tube is disposed horizontally along the longitudinal direction of the chair in the center above the upper portion of the leg base, having the forward portion thereof extended upwardly in an appropriate angle of elevation. The obliquely extended tube is provided with a guide slot which is formed along the longitudinal line on the upper side thereof and inside the tube at one side wall thereof is mounted a spring plate. The jack stay has its upper end firmly secured to the lower portion of the seat member or seat frame while its front edge being pivotally connected to a guide bar which projects into the guide slot. The guide bar is provided at the lower end thereof with a sliding block which is received and movable in the extended tube. The spring plate constantly presses against the sliding block so as to slow down the movement of the sliding block. In an easy chair adapted with the reclining mechanism of the present invention, the two sides of the back rest or back frame are connected pivotally each at the lower end thereof to an armrest rod which is in fixed connection with the chair seat at an appropriate location on each side by a pivot pin, whereas the rear end of the chair seat remains pivotally attached to the lower end of the back rest with the front end thereof being supported on the guide tube by means of the jack stay. Therefore, in using the easy chair or swivel chair having reclining mechanism of the present invention, when the backrest thereof is pivoted into a reclining position or a forwardly inclined position opposite to the lying-down position or sitting position of the body of the chair occupant, the seat pad will also be involved and moved forwardly or backwardly. During this movement, the guide bar and the sliding block will likewise be moved in the guide tube, and being urged by the pressure of the spring plate, both the movement of the chair seat and the reclination or inclination of the backrest will thereby be slowed down.

1 Claim, 3 Drawing Figures

RECLINING MECHANISM FOR EASY CHAIR

DETAILED DESCRIPTION

The present invention relates to a reclining mechanism for an easy chair or swivel chair, and more particularly, to a reclining mechanism in which the guide bar of a pivotal connection disposed beneath the chair seat is slidably movable in a guide tube located at the upper portion of the chair legs, whereby the chair seat can be moved back and forth relative to the leg base and the angle of inclination between the chair seat and the backrest can be varied.

In accordance with the present invention, a kind of reclining mechanism for use in an easy chair or swivel chair comprises a guide tube and a jack stay. The guide tube is horizontally mounted in the longitudinal direction of the chair and located in the center on the upper portion of the leg base, the forward portion being slightly extended in an upward position to form an obliquely extended tube. On the upper side of this extended tube is formed a longitudinal guide slot while inside the tube a spring plate is provided on one side wall thereof. The jack stay, on the other hand, is projected out from the lower portion of the chair seat or seat frame with the lower end thereof being pivotally connected to a guide bar which is to be positioned in the guide slot of the extended tube. The guide bar has at its terminal end a sliding block which is slidably movable in the obliquely extended tube. The aforesaid spring plate constantly presses against the sliding block so as to slow down the movement of the sliding block. In the easy chair or swivel chair of this invention, the two vertical sides of the backrest or back frame are pivotally connected at the lower end each by means of a pivot pin to an armrest rod which is firmly positioned at the upper portion of the leg base. The chair seat or seat frame is likewise pivotally connected at the rear end thereof to the lower end of the backrest, with the front portion of the chair seat being supported on the guide tube by means of the jack stay which lies therebeneath. As such, when the backrest is pivoted into a rearwardly reclined position following the lying down of the body of the chair occupant, the lower portion of the backrest may turn around the pivot pins, which connect the backrest to the armrests on the opposite sides, in a forward manner and the chair seat will thereby be pushed and moved forward. During this movement, the guide bar at the front end of the jack stay and the sliding block will also be moved in a forward manner in the guide tube when the body of the chair occupant is returned to a sitting position, the chair seat may be moved rearwardly by the backward sliding of the guide bar located at the front end of the jack stay and the sliding block. At this moment, the backrest will be pushed by the chair seat to be inclined in a forward manner. Owing to the sliding block being constantly pressed against by the spring plate, the incling or reclining movement between the backrest and the chair seat can thus be slowed down.

Accordingly, in the reclining mechanism of the present invention, the angle of inclination between the backrest and the chair seat is varied with the moving of the center of gravity in the sitting or lying-down position of the body of the chair occupant, and because of the slowing-down effect of the spring plate, the change-over action in the angle of inclination of the backrest is rather smooth, which will thus enhance the comfortability of the chair.

Other aspects and advantages of the present invention will become apparent from the following description of the preferred embodiment taken in conjunction with accompanying drawings wherein.

Figure 1:
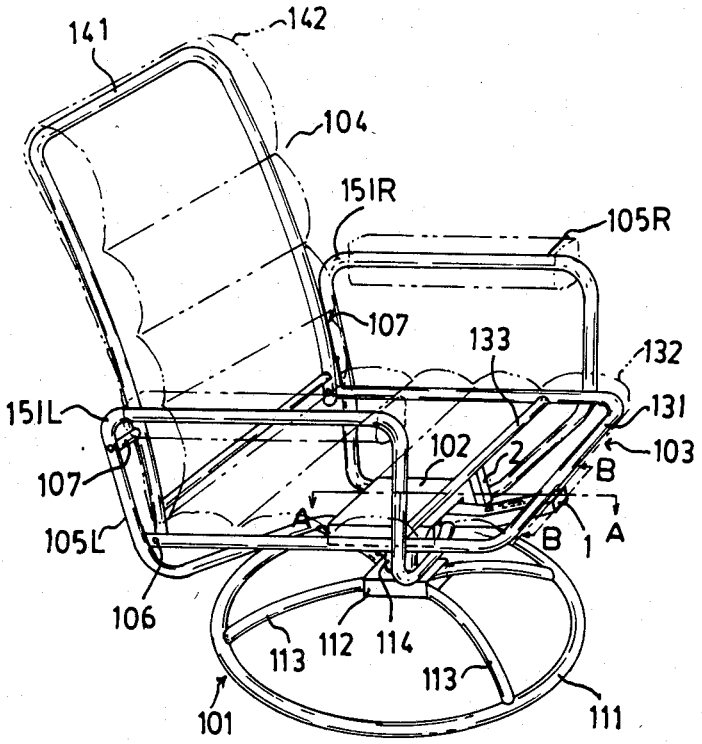
FIG. 1 is a perspective view of an embodiment of an easy chair having reclining mechanism in accordance with the present invention.
Figure 3:
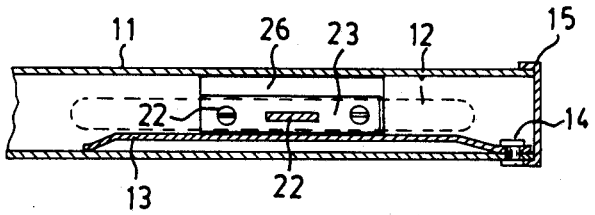
FIG. 3 is a sectional view of the embodiment taken along the line of B—B of FIG. 1.
Figure 2:
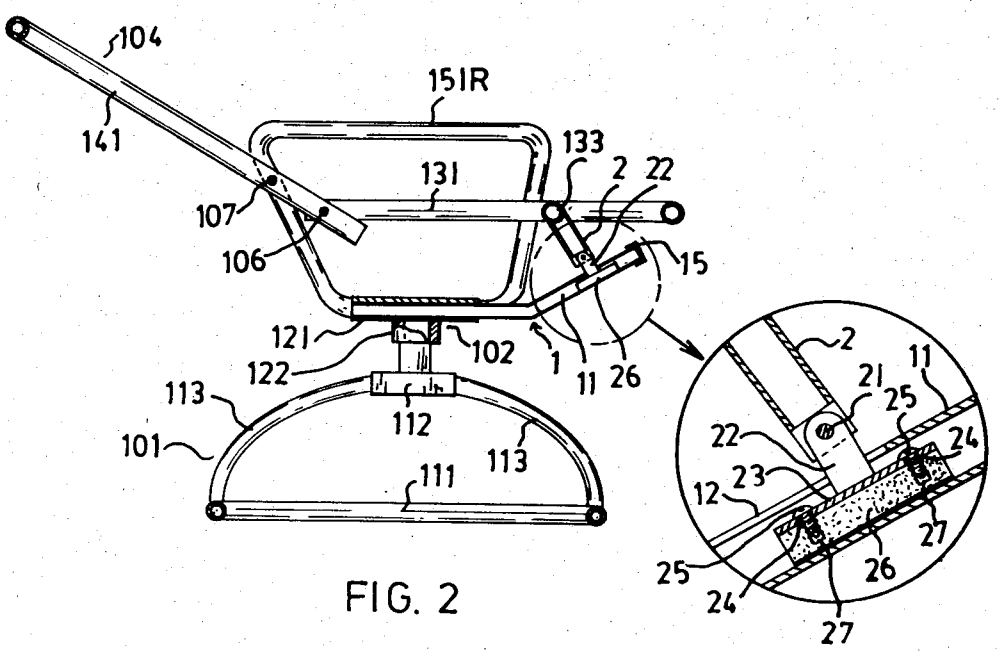
FIG. 2 is a sectional view of the embodiment taken along the line A—A of FIG. 1, with the reclining mechanism of the present invention shown in detail.

With reference now to FIGS. 1 to 3, there is shown and illustrated an embodiment of a reclining mechanism constructed in accordance with the principles of the present invention for use in an easy chair which comprises a leg base 101, a linkage base 102, a chair seat 103, a backrest 104 and left and right armrests, 105L and 105R. The leg base 101 consists of a ring bar 111 and a base element 112, the ring bar 111 being mounted on all sides thereof with 4 legs 113 and the free ends of the legs are firmly connected with the base element 112. A shaft bar 114 is projected upward from the upper portion of the base element 112. The linkage base 102 is a case-like structure open at both front and rear ends, a bottom plate 121 of the linkage bar 102 being rotatably mounted by a sleeve 122 on the shaft bar 114 and rotatable thereabout. The chair seat 103 consists of a seat frame 131 and a seat pad 132, and the backrest 104 is made of a back frame 141 and a back pad 142. The two longitudinally arranged side bars of the seat frame 131 are connected at the rear ends thereof to the lower portions of the two side bars, also arranged longitudinally, of the back frame 141 by pivot pins 106. The two armrests, 105L and 105R, are fixed respectively by means of its armrest rod, 151L and 151R, by the corresponding inner sides thereof to the two longitudinal sides inside the case-like structure of the aforesaid linkage base 102. At an appropriate location adjacent the upper end of the rear side of each armrest rod, 151L and 151R, is mounted a pivot pin 107 which is inwardly projected, and the aforesaid back frame 141 has its longitudinally arranged side bars being pivotably connected between the two pivot pins 107. In addition, a cross bar 133 for fixing of a jack stay, described hereinafter, of the reclining mechanism in accordance with the present invention at the center thereof, is provided at an appropriate location adjacent the front end of the two longitudinally arranged side bars of the aforesaid seat frame 131.

The reclining mechanism of the present invention, as shown in FIGS. 1 to 3, comprises a guide tube 1 and a jack stay 2.

In the embodiment described herein, the guide tube 1 is preferably made from a square tubing, the rear section of which being horizontally fixed in the linkage base 102 which is located above the leg base 101, and the front section of which being projected outwardly over the front of the linkage base. This projected front section is slightly raised upward in an appropriate angle and forms an obliquely extended tube 11. On the upper side surface of the extended tube 11 there is formed longitudinally a guide slot 12 which passes through the upper side wall of the extended tube 11. The extended tube 11 is also provided internally one on inner side wall on one side thereof with an arc-shaped spring leaf 13 which has its front end secured firmly to the front end of that inner side wall of the extended tube 11 by fastening means as rivets 14 or fastened in other manner. Furthermore, the obliquely extended tube 11 is provided at the front end thereof with a closure 15 to close up the opening into the tube.

The jack stay 2 in the present embodiment is also made from a square tubing having the upper end thereof firmly secured to the lower edge of the cross bar 133 in the seat frame 131 and the lower end thereof pivotally connected to a guide bar 22 by means of a pivot bolt 21. This guide bar 22 has at the lower side thereof a base plate 23 which is provided at appropriate locations in the front and rear portion thereof respectively with a through hole 24, whereby a sliding member 26 which is located beneath the base plate 26 is fastened thereto by screw bolts 25. The sliding member 26 may be formed from nylon and the like, and is a rectangular column body having on the top side thereof in locations corresponding to the positions of the front and rear through holes 24 respectively a fixing hole or screw hole 27 whereby the sliding member 26 is held securely by screw bolts 25. Moreover, the guide bar 22 and the base plate 23 must be able to pass through the guide slot 12 of the guide tube 1 and the sliding member 26 must also be slidably movable in the extended tube 11. Owing to the fact that the sliding member 26 must be constantly pressed against on one side by the arc-shaped spring leaf 13, the sideway movement of the sliding member will be rather smooth and any loosening in the movement will not otherwise be produced.

According to the construction described above, when the body of the chair occupant is to lie down on the back, the upper side of the backrest 104 being exerted on by the pressure will be turned backward and downward about the axis formed at the pivot pin 107 where the backrest 104 is pivotably connected to the armrest rods, 151L and 151R. Following this movement, the lower side of the backrest 104 will be turned forward and upward, and as chair seat 103 is being pushed to move forward, the guide bar 22 which is located below the jack stay 2 and its sliding member 26 will also be moved to slide forward along the extended tube of the guide tube 1. In this way, the angle of elevation between the chair seat 103 and the backrest 104 will be gradually widened until the front side of the guide bar 22 is brought into contact with the front edge of the guide slot when, the angle of elevation between the chair seat 103 and the backrest 104 will arrive at a maximum, thereby permitting the chair occupant to lie on the chair with complete ease. On the other hand, when the chair occupant is to sit upright, the center of gravity of the occupant's body will be shifted to the chair seat 103 and in consequence, the guide bar 22 and its sliding member 26 will be moved to slide downward and backward along the extended tube 11 and the chair seat 103 will also be moved backward. During this movement, the lower side of the backrest 104 will be pushed to move backward, whereas the upper side of the backrest 104 will be turned forwardly about the axis formed at the pivot pin 107 until the rear side of the guide bar 22 is brought into contact with the rear edge of the guide slot 12 when, the angle of elevation between the backrest 104 and the chair seat 103 will be in a minimum, that is, an angle at which the normal sitting posture can generally be assumed.

Owing to the fact that the angle of inclination of the chair can be varied in accordance with the shifting of the center of gravity relative to the sitting or lying-down position of the chair occupant's body, it may be submitted that the reclining mechanism for chair of the present invention needs no extra device for adjustment, and is hence very convenient in use. Furthermore, since the sliding movement of the guide bar 22 and the sliding member 26 thereof is being slowed down by the pressure exerted against thereon by the spring leaf 13, the process of inclining or tilting will be very smooth with no loosening in movement being resulted in any way. In this way, the novel reclining mechanism further adds comfort and ease to the chair body and the practical applicability of the mechanism is thereby made eminent.

I claim:

1. A reclining mechanism for easy chair or swivel chair of the type including a leg base and a chair seat, said mechanism comprising a guide tube firmly secured above the leg base, a jack stay projected from beneath the chair seat; said guide tube being slightly tilted upward at the front portion thereof to form an obliquely extended tube, said extended tube having a guide slot formed on the upper side thereof, a guide bar pivotably connected with the lower end of said jack stay and adapted to pass through said guide slot, said guide bar being provided at the lower end thereof with a sliding member which is contained and slidably movable in said extended tube, a space formed between said sliding member and an inner wall of one side of said obliquely extended tube, and an arc-shaped spring plate mounted on the inner side wall of said extended tube, said spring constantly pressing against said sliding member so as to exert a slow-down effect on the movement of said sliding member.

* * * * *